United States Patent [19]

Künzig et al.

[11] Patent Number: 5,027,462

[45] Date of Patent: Jul. 2, 1991

[54] ARRANGEMENT FOR REMOVING DUST IN FOLDERS FOR PRINTING MACHINES

[75] Inventors: Herman Künzig; Günter Thoma, both of Weil am Rhein, Fed. Rep. of Germany

[73] Assignee: Eltex-Elektrostatik-Gesellschaft mbH, Fed. Rep. of Germany

[21] Appl. No.: 514,536

[22] Filed: Apr. 26, 1990

[30] Foreign Application Priority Data

Apr. 29, 1989 [DE] Fed. Rep. of Germany ..... 3914310

[51] Int. Cl.[5] ..... B08B 5/04; B08B 6/00

[52] U.S. Cl. ..... 15/1.51; 15/309.1; 101/227; 226/197; 270/21.1

[58] Field of Search ..... 15/301, 309.1, 1.51; 101/219, 227; 226/197; 270/21.1

[56] References Cited

U.S. PATENT DOCUMENTS

| | | | |
|---|---|---|---|
| 2,082,411 | 6/1937 | Merrill | 15/309.1 |
| 2,818,595 | 1/1958 | Rosewall | 15/309.1 |
| 3,420,710 | 1/1969 | Wollman | 15/309.1 X |
| 4,026,701 | 5/1977 | Till et al. | 15/309.1 X |
| 4,454,621 | 6/1984 | Testone | 15/309.1 X |
| 4,824,002 | 4/1989 | Ford et al. | 226/197 |

*Primary Examiner*—Chris K. Moore

*Attorney, Agent, or Firm*—Evenson, Wands, Edwards, Lenahan, & McKeown

[57] ABSTRACT

A dust removal arrangement for a turning bar in folders for printing machines has the turning bar surrounded by several suction chambers which, when viewed in cross-sectional, are arranged in a semicircular manner successively in parallel to the turning bar axis as well as in the moving direction of the paper, at least in the area of one of the lateral edges of the paper moving path. Discharge electrodes, has a d.c. voltage applied and are arranged at the paper inlet in the front area of the first suction chamber and at the paper outlet in the area behind the last suction chamber opposite the turning bar.

21 Claims, 1 Drawing Sheet

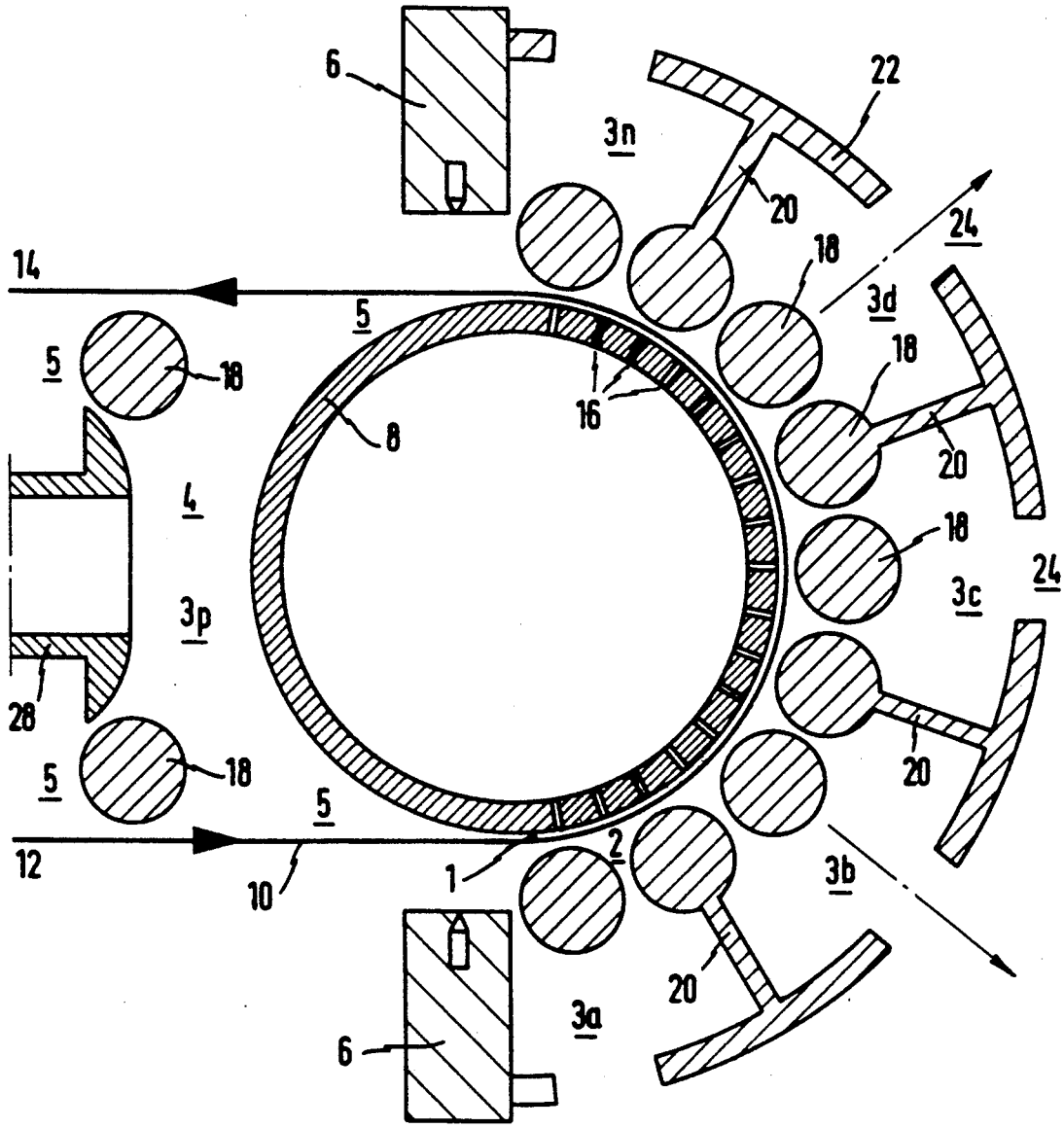
6
22
3n
20
24
14
18
3d
5
18
5
16
8
20
4
18
3c
24
3p
28
5
18
20
5
12
10
1
2
3b
20
3a
6

ARRANGEMENT FOR REMOVING DUST IN FOLDERS FOR PRINTING MACHINES

BACKGROUND AND SUMMARY OF THE INVENTION

The present invention relates to an arrangement for removing dust from turning bars in folders for printing machines and more particularly, to a dust removal arrangement in which one or more suction chambers are provided in the area of one of the two lateral edges of a paper web and discharge electrodes are arranged at the paper inlet.

Folders used, for example, for printing machines have turning bars by which the moving direction of the paper webs passing through is reversed. By virtue of ventilated turning bars, the cutting dust carried along at the cutting edges is repelled an deposited both by the blowing air of the turning bar and the centripetal acceleration. As a result, dust formation impairs the operation of the whole folder and, up to now, has made it necessary to clean the folder mechanically at certain time intervals.

It is an object of the present invention to provide an arrangement for removing dust which occurs during cutting widths of material in printing machines which makes mechanical cleaning unnecessary.

The foregoing object of the present invention has been achieved by providing an arrangement in which, at least in the area of one of two lateral edges of the paper web, one or more chambers are provided, each extending in the same direction as the turning bar, and one or more individually arranged one behind the other in a curved manner, in the moving direction of the paper, around a portion of the turning bar, with discharge electrodes arranged at the paper inlet in the area in front of a first suction chamber and at the paper outlet in the area behind the last suction chamber on the side of the paper web not having the turning bar.

According to a presently preferred embodiment of the present invention, at least in the area of one of the lateral edges of the paper web at which a dust removal is to take place, the turning bar, as viewed in cross-section, has a semicircular portion surrounded by several suction chambers. The suction chambers may also be arranged, however, so that, in respective pairs, they cover the two lateral edges of the paper web. When creation of a large amount of dust is expected, suction chambers may also be arranged over the entire width of the paper web.

A high d.c. voltage is applied to discharge electrodes arranged at the paper inlet and at the paper outlet in which case the turning bar, preferably with respect to this d.c. voltage, may be grounded or insulated by an appropriately sized bleeder resistor. Because of the low dust formation, the danger of an explosion caused by dust is thereby reduced.

As a result of the semicircular arrangement of the suction chambers, as viewed in cross-section, the dust particles which are thrown off tangentially during rotation around the turning bar are sucked away. The suction effect can be further improved when the turning bar is rigid and hollow and, at least in the angle of wrap of the paper web, has a perforation to which compressed gas or compressed air is supplied by way of the interior of the hollow turning bar. This compressed gas or compressed air is then sucked off by the suction chambers. This arrangement has the advantage that an air cushion is generated on the turning bar over which the paper web "floats" when it moves over the turning bar. In addition, the rotation of the paper web around the turning bar is improved because it exercises a suction effect on the paper web, while the air cushion reduces the frictional forces. The high air current formed at the edges of the paper web promotes the suction effect during the dust removal.

A further feature of the present invention includes the space between the paper inlet and the paper outlet being constructed as a suction chamber. As a result, the dust particles occurring between the webs and the dust particles deposited on the rear side of the turning bar because of turbulence are also sucked off.

The suction chambers which surround the turning bar in a semicircular arrangement, as viewed in cross-section, and which are connected with a suction device, such as a pump, at their sides facing the paper web or the turning bar, are bounded, at their sides facing the paper web or the turning bar, by a plurality of roller-shaped boundary elements which are arranged at such distances from one another that sufficient space remains between them for the passage of the sucked-off dust particles. Roller-shaped boundary elements have proved to be particularly effective for this purpose because they offer fewer points of attachment for deposition of the dust particles to be sucked off. The suction chamber disposed in the space between the paper inlet and the paper outlet, at its side facing the turning bar, may be bounded at least partially by the roller-shaped boundary elements.

BRIEF DESCRIPTION OF THE DRAWINGS

These and other objects, advantages and features of the present invention will become more apparent from the following detailed description of a presently preferred embodiment when taken in conjunction with the accompanying sole FIGURE of a vertical section view of the longitudinal axis of the turning bar of the dust removal arrangement with respect to the plane of the entering and exiting paper web.

DETAILED DESCRIPTION OF THE DRAWINGS

A paper web 10 moves around a turning bar 8 in such a manner that a paper inlet 12 extends toward the lower edge of the turning bar, and a paper outlet 14 extends from the upper edge of the turning bar. As a result, the angle of wrap of the paper web 10 around the turning bar 8 is 180°. The turning bar 8 is hollow and has multiple perforations 16 in its annular wall inside the angle of wrap. Compressed gases or compressed air, which are guided through the perforations 16 from the interior of the hollow turning bar 8, are discharged in the direction of the paper web 10. As a result, an air cushion 1 is formed between the turning bar 8 and the paper web 10, so that the paper web 10 rests on the turning bar 8 almost without any friction. The compressed air or compressed gases discharged through the perforations 16 are guided under the paper web 10 laterally to its edges.

Several suction chambers 3 are arranged in parallel to the axis of the turning bar 8 behind one another in the moving direction of the paper and surround the turning bar in a cross-sectionally semicircular arrangement. In the circumferential direction of the turning bar 8, the suction chambers 3 are bounded by roller-shaped boundary elements 18 arranged at distances such that a space remains between them for the passage of the dust particles to be sucked off as well as of the compressed air or compressed gases. Each suction chamber 3 is bounded by lateral walls 20 and by a rear wall 22. A connection piece 24 for connection with a conventional vacuum device, such as a vacuum pump (not shown), is provided inside the rear wall 22. The radially thrown-off dust particles 2 entering between the roller-shaped boundary elements 18 into the suction chambers 3 as well as the gases are sucked off through these connection pieces 24.

Another suction chamber 3*p* is provided in the space between the paper inlet 12 and the paper outlet 14 and is bounded, at the side facing away from the turning bar 8, by a suction piece 28 as well as by roller-shaped boundary elements 18. By virtue of this suction chamber 3*p*, the particles 4 between the webs are sucked off as well as the particles 5 deposited as a result of turbulences.

A discharge electrode 6 is arranged at the paper inlet 12 in the front area of the first suction chamber 3*a*. A high d.c. voltage is applied to the discharge electrode 6. In the same manner, a discharge electrode $6^1$ is arranged in the area behind the last suction chamber 3*n* opposite the turning bar 8. A high d.c. voltage also is applied to this discharge electrode $6^1$. The turning bar 8 is grounded with respect to this d.c. voltage of the two discharge electrodes 6, $6^1$ by a bleeder resistor (not shown) in a known manner.

As a result of the interaction of the suction chambers 3*a* to 3*n* and 3*p* with the two discharge electrodes 6, $6^1$ a high dust removal effect is achieved in the area of the turning bar 8, so that no mechanical cleaning is required and the danger of a dust-caused explosion is reduced.

While a presently preferred embodiment has been shown and described, it should be understood that the same will now be susceptible to changes and modifications to one skilled in the art given the details disclosed herein. Therefore, it is not intended that the present invention be limited necessarily to what has been shown and described but rather that the invention be construed as defined in the appended claims.

What is claimed:

1. An arrangement for removing dust which occurs during the cutting of widths of moving material on a folder turning bar for the deflecting of the material, wherein at least in the area of one of two lateral edges of the material, a plurality of suction chambers are provided extending in the same direction as the turning bar and are individually arranged one behind the other in a moving direction of the material around a portion of the turning bar in a curved path, and discharge electrodes are arranged at a paper inlet in an area in front of a first of the suction chambers and at a paper outlet in the area behind the last of the suction chambers on the side of the material opposite the turning bar.

2. The arrangement according to claim 1, wherein the discharge electrodes have a high operational voltage applied thereto.

3. The arrangement according to claim 1, wherein the turning bar is grounded by a resistor.

4. The arrangement according to claim 3, wherein the discharge electrodes have a high operational voltage applied thereto.

5. The arrangement according to claim 1, wherein the turning bar is electrically insulated.

6. The arrangement according to claim 5, wherein the discharge electrodes have a high operational voltage applied thereto.

7. The arrangement according to claim 1, wherein a vacuum source is operatively connected with the suction chambers.

8. The arrangement according to claim 7, wherein the discharge electrodes have a high operational voltage applied thereto.

9. The arrangement according to claim 8, wherein the turning bar is grounded by a resistor.

10. The arrangement according to claim 9, wherein the turning bar is electrically insulated.

11. The arrangement according to claim 1, wherein a suction chamber is provided in a space between the paper inlet and the paper outlet on an interior side of the material.

12. The arrangement according to claim 11, wherein the discharge electrodes have a high operational voltage applied thereto.

13. The arrangement according to claim 12, wherein the turning bar is grounded by a resistor.

14. The arrangement according to claim 13, wherein the turning bar is electrically insulated.

15. The arrangement according to claim 14, wherein a vacuum source is operatively connected with the suction chambers.

16. The arrangement according to claim 1, wherein the turning bar is hollow and torsionally fixed and, at least in the area of the angle of wrap of the material, has at least one perforation supplied with compressed gas or compressed air from the interior of the hollow turning bar.

17. The arrangement according to claim 16, wherein the angle is about 180°.

18. The arrangement according to claim 17, wherein the discharge electrodes have applied a high operational voltage applied thereto.

19. The arrangement according to claim 1, wherein the suction chambers have a plurality of spaced roller-shaped boundary elements at their sides facing the material.

20. The arrangement according to claim 1, wherein the suction chambers are arranged in respective pairs over the two lateral edges of the material.

21. The arrangement according to claim 1, wherein the suction chambers extend over the entire width of the material.

* * * * *